US005600430A

United States Patent [19]

Folkins et al.

[11] Patent Number: 5,600,430

[45] Date of Patent: Feb. 4, 1997

[54] SPLIT RECHARGE METHOD AND APPARATUS FOR COLOR IMAGE FORMATION

[75] Inventors: Jeffrey J. Folkins, Rochester; Roger L. Bullock; Thomas J. Fleck, both of Webster; Kenneth W. Pietrowski; Charles H. Tabb, both of Penfield; Zhao-Zhi Yu, Webster; Mark A. Gwaltney, Fairport, all of N.Y.

[73] Assignee: Xerox Corporation, Stamford, Conn.

[21] Appl. No.: 347,617

[22] Filed: Nov. 30, 1994

[51] Int. Cl.[6] ..... G03G 15/01

[52] U.S. Cl. ..... 399/171; 399/89; 399/223

[58] Field of Search ..... 355/326 R, 327, 355/328

[56] References Cited

U.S. PATENT DOCUMENTS

| | | | |
|---|---|---|---|
| 4,033,688 | 7/1977 | Orthmann | 355/327 X |
| 4,141,648 | 2/1979 | Gaitten et al. | 355/225 |
| 4,432,631 | 2/1984 | Bacon et al. | 355/225 |
| 4,660,059 | 4/1987 | O'Brien | 346/157 |
| 4,761,669 | 8/1988 | Langdon | 355/326 |
| 4,791,452 | 12/1988 | Kasai et al. | 355/326 |
| 4,819,028 | 4/1989 | Abe | 355/4 |
| 4,833,503 | 5/1989 | Snelling | 355/259 |
| 4,868,611 | 9/1989 | Germain | 355/328 |
| 5,208,636 | 5/1993 | Rees et al. | 355/219 |
| 5,241,356 | 8/1993 | Bray et al. | 355/328 |
| 5,258,820 | 11/1993 | Tabb | 355/328 |
| 5,339,135 | 8/1994 | Scheuer et al. | 355/326 X |
| 5,408,299 | 4/1995 | Haas | 355/327 X |

FOREIGN PATENT DOCUMENTS 1-340663 9/1991 Japan .

OTHER PUBLICATIONS

European Patent Application; NEC Corporation; Publication No. 0 263 501; Electrophotographic Recording Apparatus for Forming a Multicolor Image; Publication Date Apr. 13, 1988.

European Patent Application; Charles H. Tabb; Publication No.; 0 581 563 A2 Pre–recharge Device for Voltage Uniformity in Read Color Systems; Publication Date Feb. 2, 1994.

Patent Abstracts of Japan; Publication No. JP59038762; Publication Date Feb. 3, 1984; V. 8 No. 137; Tashiro Jiyunichi; *Multicolor Recorder.*

*Primary Examiner*—Fred L. Braun

[57] ABSTRACT

In a multi-color imaging apparatus utilizing a recharge step between two image creation steps for recharging a charge retentive surface to a predetermined potential pursuant to forming the second of the two images, a first corona generating device recharges the charge retentive surface to a higher absolute potential than a predetermined potential, and then a second corona generating device recharges the charge retentive surface to the predetermined potential. An electrical charge associated with the first image is substantially neutralized after being recharged by the first and second corona generating device.

25 Claims, 4 Drawing Sheets

SPLIT RECHARGE METHOD AND APPARATUS FOR COLOR IMAGE FORMATION

BACKGROUND OF THE INVENTION

This invention relates generally to color imaging and more particularly to the use of plural exposure and development steps for such purposes.

One method of printing in different colors is to uniformly charge a charge retentive surface and then optically expose the surface to information to be reproduced in one color. This information is rendered visible using marking particles followed by the recharging of the charge retentive surface prior to a second exposure and development. This recharge/expose/and develop (READ) process may be repeated to subsequently develop images of different colors in superimposed registration on the surface before the full color image is subsequently transferred to a support substrate. The different colors may be developed on the photoreceptor in an image on image development process, or a highlight color image development process (image next-to image). The images may be formed by using a single exposure device, e.g. ROS, where each subsequent color image is formed in a subsequent pass of the photoreceptor (multiple pass). Alternatively, each different color image may be formed by multiple exposure devices corresponding to each different color image, during a single revolution of the photoreceptor (single pass).

Several issues arise that are unique to the REaD image on image process of creating multi-color images in the attempt to provide optimum conditions for the development of subsequent color images onto previously developed color images. For example, during a recharge step, it is important to level the voltages among previously toned and untoned areas of the photoreceptor so that subsequent exposure and development steps are effected across a uniformly charged surface. The greater the difference in voltage between those image areas of the photoreceptor previously subjected to a development and recharge step; those image areas subjected to a development step, but not yet subjected to a recharge step; and those bare non-developed, untoned areas of the photoreceptor, the larger will be the difference in the development potential between these areas for the subsequent development of image layers thereon.

Another issue that must be addressed with the image on image color image formation process is the residual charge and the resultant voltage drop that exists across the toner layer of a previously developed area of the photoreceptor. Although it may be possible to achieve voltage uniformity by recharging this previously toned layer to the same voltage level as neighboring bare areas, the associated residual toner voltage ($V_t$) prevents the effective voltage above any previously developed toned areas from being re-exposed and discharged to the same level as neighboring bare photoreceptor areas which have been exposed and discharged to the actual desired voltage levels. Furthermore, the residual voltage associated with previously developed toner images reduces the dielectric and effective development field in the toned areas, thereby hindering the attempt to achieve a desired uniform consistency of the developed mass of subsequent toner images. The problems become increasingly severe as additional color images are subsequently exposed and developed thereon. Color quality is severely threatened by the presence of the toner charge and the resultant voltage drop across the toner layer. The change in voltage due to the toned image can be responsible for color shifts, increased moire, increased color shift sensitivity to image misregistration and motion quality, toner spreading at image edges, and loss in latitude affecting many of the photoreceptor subsystems. Thus, it is ideal to reduce or eliminate the residual toner voltage of any previously developed toned images.

Prior attempts to address one or more of these issues have introduced a variety of secondary problems, each having an adverse effect on the image on image color image formation process. For example, the concurrently filed, copending application for patent entitled "Method and Apparatus for Reducing Residual Toner Voltage", Ser. No. 08/347,616 which was filed on 30 Nov. 1994, by a common assignee as the present application, discloses a voltage sensitive recharge device used for the recharging steps during a color image formation, whose graph of the output current (I) to the charge retentive surface as a function of the voltage to the charge retentive surface (V) has a high (I/V) slope. The high IN slope recharge device disclosed having an AC voltage supplied thereto, enables an extended time for neutralization to occur at the top of the toner layers. However, the amount of residual voltage $V_t$ reduction that can be realized is limited in this system.

Another recharging method is described in application for Japanese Patent No. Hei 1-340663, Application date Dec. 29, 1989, Publication date Sep. 4, 1991, assigned to Matsushita Denki Sangyo K.K. This reference discloses a color image forming apparatus wherein a first and second charging device are used to recharge a photoconductor carrying a first developed image, before exposure and development of a subsequent image thereon. The potential of the photoconductor is higher after passing the first charging device than after passing the second charging device. This reference teaches that the difference in voltage applied by the first and second charging devices to the toner image and photoreceptor surface is set to a relatively high level, to ensure that the polarity of the toner image is reversed after passing and having been charged by both devices. The effect of this teaching is to reduce the residual charge in the image areas which becomes more severe when applying color toners onto previously developed color toners, and also to prevent toner spray (or toner spread) during the exposure process. Toner spray is a phenomena caused when the photoconductor carrying the first toner image is recharged to a relatively high charge level and then exposed for the second image development. In areas where the edges of a prior developed image align but do not overlap with the edges of a subsequent image, the toner of the prior image tends to spray or spread along its edges into the subsequently exposed areas which have a relatively lower charge level. By reversing the polarity of the toner as taught in this reference, toner spray is prevented, as the reversed polarity toner is no longer attracted to the exposed areas.

However, when a substantial amount of toner charge at the top of a previously developed toner layer is reversed in polarity during recharge, a different problem of a serious nature develops. Since the prior toner image is now predominantly of an opposite polarity to both the background bare areas and the incoming color toner to be developed thereon, an interaction occurs among these three separate and distinctly charged regions. For example, in a system having a negatively charged photoreceptor using discharged area development (DAD), the negatively charged toner used for development would be reversed in polarity after recharge using the teachings of Matsushita. Particularly, the now-positively charged toner layer is then attracted to the negatively charged background areas and the negatively charged toner of the incoming color image. Thus, the positively charged toner of the first image tends to splatter into neighboring bare background regions. This occurrence has been titled the "under color splatter" defect (UCS) and is the cause for the unwanted blending of colors and the spreading of colors from image edges into background areas. The UCS defect is apparent both where the prior image aligns with a subsequent image, and also where the prior image overlaps with the subsequent image. Consequently, color clarity is severely impacted. Furthermore, when a relatively large voltage difference between the first and second charging devices is applied to the photoreceptor surface in order to reverse the polarity of the toner image, a significant amount of stress is applied to the photoreceptor, which may also negatively impact image quality, as well as reduce the life expectancy of the photoreceptor.

Based on the foregoing, a highly reliable and consistent manner of recharging the photoreceptor to a uniform level is needed, whereby the residual voltage on previously toned areas is minimized and the undercolor splatter defect is prevented. Furthermore, a recharging process is needed that does not impair image transfer and that does not unduly stress the photoreceptor.

The following references may be found relevant to the present disclosure.

U.S. Pat. No. 4,791,452 relates to a two-color imaging apparatus wherein a first latent image is formed on a uniformly charged imaging surface and developed with toner particles. The charge retentive surface containing a first developed or toned image, and undeveloped or untoned background areas is then recharged by a scorotron charging device prior to optically exposing the surface to form a second latent electrostatic image thereon. An electrical potential sensor detects the surface potential level of the drum to ensure that a prescribed surface potential level is reached. The recharging step is intended to provide a uniformly charged imaging surface prior to effecting a second exposure.

U.S. Pat. No. 4,819,028 discloses an electrophotographic recording apparatus capable of forming a clear multicolor image including a first visible image of a first color and a second visible image of a second color on a photoconductive drum. The electrophotographic recording apparatus is provided with a conventional charger unit and a second corona charger unit for charging the surface of the photoconductive drum after the first visible image is formed thereon so as to increase the surface potential of the photoconductive drum to prevent the first visible image from being mixed with a second color and also from being scratched off from the surface of the photoconductive drum by a second magnetic brush developing unit.

U.S. Pat. No. 4,761,669 relates to creating two-color images. A first image is formed using the conventional xerographic process. Thus, a charge retentive surface is uniformly charged followed by light exposure to form a latent electrostatic image on the surface. The latent image is then developed. A corona generator device is utilized to erase the latent electrostatic image and increase the net charge of the first developed image to tack it to the surface electrostatically. This patent proposes the use of an erase lamp, if necessary, to help neutralize the first electrostatic image. A second electrostatic image is created using an ion projection device. The ion image is developed using a second developer of a different color.

U.S. Pat. No. 4,033,688 discloses a color copying apparatus which utilizes a light-lens scanning device for creating plural color images. This patent discloses multiple charge/expose/develop steps.

U.S. Pat. No. 4,833,503 discloses a multi-color printer wherein a a recharging step is employed following the development of a first image. This recharging step, according to the patent is used to enhance uniformity of the photoreceptor potential, i.e. neutralize the potential of the previous image.

U.S. Pat. No. 4,660,059 discloses an ionographic printer. A first ion imaging device forms a first image on the charge retentive surface which is developed using toner particles. The charge pattern forming the developed image is neutralized prior to the formation of a second ion image by a corona generating unit and an erase lamp.

U.S. Pat. No. 5,208,636, discloses a printing system wherein charged area images and discharged area images are created, the former being formed first and the latter being proceeded by a recharging of the imaging surface.

U.S. Pat. No. 5,241,356 discloses a multi-color printer wherein charged area images and discharged area images are created, the former being formed first, followed by an erase step and a recharge step before the latter is formed. An erase lamp is used during the erase step to reduce voltage non-uniformity between toned and untoned areas on a charge retentive surface.

U.S. Pat. No. 5,258,820 discloses a multi-color printer wherein charged area images and discharged area images are created. An erase lamp is used following development of a charged area (CAD), and a pre-recharge corona device is used following development of a discharged area (DAD) and prior to a recharge step, to reduce voltage non-uniformity between toned and untoned images on a charge retentive surface.

The concurrently filed, copending application for U.S. patent titled "Method and Apparatus for Reducing Transferred Background Toner", Ser. No. 08/346,708 which was filed on 30 Nov. 1994 by a common assignee as the present application, discloses a corona recharge device for recharging the photoreceptor containing at least one previously developed color image, to a voltage level intermediate to the background areas and the image areas. This intermediate recharge level keeps wrong-charge toner developed in the background areas at a charge level distinct from the toner developed in the image areas, so that the wrong-charge background toner does not transfer to a support substrate with the image.

A number of commercial printers employ the charge/expose/develop/recharge imaging process. For example, the Konica 9028, a multi-pass color printer forms a single color image for each pass. Each such pass utilizes a recharge step following development of each color image. The Panasonic FPC1 machine, like the Konica machine is a multi-pass color device. In addition to a recharge step the FPC1 machine employs an AC corona discharge device prior to recharge.

SUMMARY OF THE INVENTION

In accordance with one aspect of the invention, a corona generating apparatus recharges a charge retentive surface to a predetermined voltage. The charge retentive surface has at least one image developed thereon having an electrical charge associated therewith. A first corona generating device recharges the charge retentive surface to a higher absolute potential than the predetermined potential, followed by a second corona generating device which recharges the charge retentive surface to the predetermined potential. The difference in charge retentive surface potential after being recharged by the first corona generating device and the predetermined potential is preselected so as to substantially neutralize the electrical charge associated with the developed image.

In accordance with another aspect of the invention, a printing machine for creating multiple images is disclosed, comprising a charge retentive surface having a developed image thereon, the developed image having an electrical charge associated therewith. The machine also comprises a corona generating device for recharging the charge retentive surface to a predetermined voltage, whereby a first corona generating device recharges the charge retentive surface to a higher absolute potential than the predetermined potential, followed by a second corona generating device which recharges the charge retentive surface to the predetermined potential. The difference in charge retentive surface potential after being recharged by the first corona generating device and the predetermined potential is preselected so as to substantially neutralize the electrical charge associated with the developed image.

In accordance with yet another aspect of the invention, a method for creating multiple images is disclosed. The method comprises the steps of recording a latent image on a charge retentive surface, developing the latent image, the developed image having an electrical charge associated therewith, and predetermining a surface potential for recharging the charge retentive surface and the developed image thereto. The method then includes recharging the charge retentive surface with a first corona generating device to a higher absolute potential than the predetermined potential, recharging the charge retentive surface with a second corona generating device to the predetermined potential, and substantially neutralizing the electrical charge associated with the developed image.

DETAILED DESCRIPTION OF THE PREFERRED EMBODIMENT OF THE INVENTION

This invention relates to an imaging system which is used to produce an image on image color output in a single revolution or pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass image on image color process system, and a single or multiple pass highlight color system.

Figure 1:
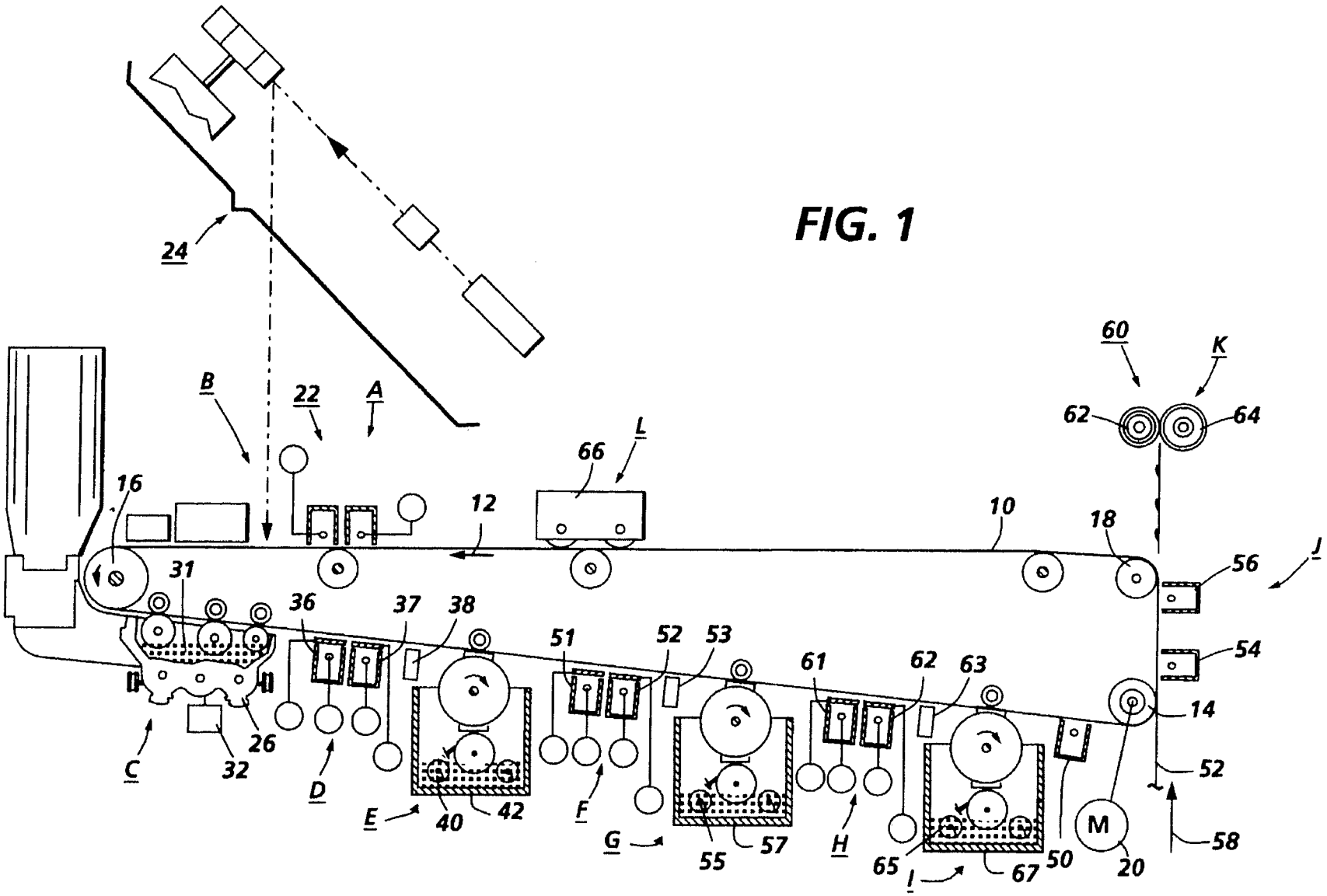
FIG. 1 is a schematic illustration of an imaging apparatus incorporating the development system features of the invention.

Turning now to FIG. 1, the electrophotographic printing machine of the present invention uses a charge retentive surface in the form of an Active Matrix (AMAT) photoreceptor belt 10 supported for movement in the direction indicated by arrow 12, for advancing sequentially through the various xerographic process stations. The belt is entrained about a drive roller 14 and two tension rollers 16 and 18 and the roller 14 is operatively connected to a drive motor 20 for effecting movement of the belt through the xerographic stations.

With continued reference to FIG. 1, a portion of belt 10 passes through charging station A where a corona generating device, indicated generally by the reference numeral 22, charges the photoconductive surface of belt 10 to a relatively high, substantially uniform potential. For purposes of example, the photoreceptor is negatively charged, however it is understood that the present invention could be useful with a positively charged photoreceptor, by correspondingly varying the charge levels and polarities of the toners, recharge devices, and other relevant regions or devices involved in the image on image color image formation process, as will be hereinafter described.

Next, the charged portion of photoconductive surface is advanced through an imaging station B. At exposure station B, the uniformly charged belt 10 is exposed to a laser based output scanning device 24 which causes the charge retentive surface to be discharged in accordance with the output from the scanning device. Preferably the scanning device is a laser Raster Output Scanner (ROS). Alternatively, the ROS could be replaced by other xerographic exposure devices known in the art.

The photoreceptor, which is initially charged to a voltage $V_0$, undergoes dark decay to a level $V_{ddp}$ equal to about −500 volts. When exposed at the exposure station B the image areas are discharged to $V_{DAD}$ equal to about −50 volts. Thus after exposure, the photoreceptor contains a monopolar voltage profile of high and low voltages, the former corresponding to charged areas and the latter corresponding to discharged or image areas.

At a first development station C, a magnetic brush developer structure, indicated generally by the reference numeral 26 advances insulative magnetic brush (IMB) material 31 into contact with the electrostatic latent image. The development structure 26 comprises a plurality of magnetic brush roller members. These magnetic brush rollers present, for example, negatively charged black toner material to the charged image areas for development thereof. Appropriate developer biasing is accomplished via power supply 32. Electrical biasing is such as to effect discharged area development (DAD) of the lower (less negative) of the two voltage levels on the photoreceptor with the material 31.

At recharging station D, a pair of corona recharge devices 36 and 37 are employed for adjusting the voltage level of both the toned and untoned areas on the photoreceptor surface to a substantially uniform level. A power supply coupled to each of the electrodes of corona recharge devices 36 and 37 and to any grid or other voltage control surface associated therewith, serves as a voltage source to the devices. The recharging devices 36 and 37 serve to substantially eliminate any voltage difference between toned areas and bare untoned areas, as well as to reduce the level of residual charge remaining on the previously toned areas, so that subsequent development of different color toner images is effected across a uniform development field. The first corona recharge device 36 overcharges the photoreceptor surface 10 containing previously toned and untoned areas, to a level higher than the voltage level ultimately required for $V_{ddp}$, for example to −700 volts. The predominant corona charge delivered from corona recharge device 36 is negative. The second corona recharge device 37 reduces the photoreceptor surface 10 voltage to the desired $V_{ddp}$, −500 volts. Hence, the predominant corona charge delivered from the second corona recharge device 37 is positive. Thus, a voltage split of 200 volts is applied to the photoreceptor surface. The voltage split ($V_{split}$) is defined as the difference in photoreceptor surface potential after being recharged by the first corona recharge device and the second corona recharge device, e.g. $V_{split}$=−700 volts—500 volts =−200 volts. The surface 10 potential after having passed each of the two corona recharge devices, as well as the amount of voltage split of the photoreceptor, are preselected to otherwise prevent the electrical charge associated with the developed image from substantially reversing in polarity, so that the occurrence of under color splatter (UCS) is avoided. Further, the corona recharge device types and the voltage split are selected to ensure that the charge at the top of the toner layer is substantially neutralized rather than driven to the reverse polarity (e.g. from negative to become substantially positive). These selected parameters are described in further detail with reference to FIGS. 3A–3F.

A second exposure or imaging device 38 which may comprise a laser based output structure is utilized for selectively discharging the photoreceptor on toned areas and/or bare areas to approximately −50 volts, pursuant to the image to be developed with the second color developer. After this point, the photoreceptor contains toned and untoned areas at relatively high voltage levels (e.g. −500 volts) and toned and untoned areas at relatively low voltage levels (e.g. −50 volts). These low voltage areas represent image areas which are to be developed using discharged area development. To this end, a negatively charged developer material 40 comprising, for example, yellow color toner is employed. The toner is contained in a developer housing structure 42 disposed at a second developer station E and is presented to the latent images on the photoreceptor by a non-interactive developer. A power supply (not shown) serves to electrically bias the developer structure to a level effective to develop the DAD image areas with the negatively charged yellow toner particles 40.

At a second recharging station F, a pair of corona recharge devices 51 and 52 are employed for adjusting the voltage level of both the toned and untoned areas on the photoreceptor to a substantially uniform level. A power supply coupled to each of the electrodes of corona recharge devices 51 and 52 and to any grid or other voltage control surface associated therewith, serves as a voltage source to the devices. The recharging devices 51 and 52 serve to substantially eliminate any voltage difference between toned areas and bare untoned areas, as well as to reduce the level of residual charge remaining on the previously toned areas so that subsequent development of different color toner images is effected across a uniform development field. The first corona recharge device 51 overcharges the photoreceptor surface containing previously toned and untoned areas, to a level higher than the voltage level ultimately required for $V_{ddp}$, for example to −700 volts. The predominant corona charge delivered from corona recharge device 51 is negative. The second corona recharge device 52 reduces the photoreceptor voltage to the desired $V_{ddp}$, −500 volts. Hence, the predominant corona charge delivered from the second corona recharge device 52 is positive. The surface potential after having passed each of the two corona recharge devices, as well as the amount of voltage split, are preselected to otherwise prevent the electrical charge associated with the developed image from substantially reversing in polarity, so that the occurrence of UCS is avoided. Further, the corona recharge device types and the voltage split are selected to ensure that the charge at the top of the toner layer is substantially neutralized rather than driven to the reverse polarity. These selected parameters are described in further detail with reference to FIGS. 3A–3F.

A third latent image is created using an imaging or exposure member 53. In this instance, a third DAD image is formed, discharging to approximately −50 volts those bare areas and toned areas of the photoreceptor that will be developed with the third color image. This image is developed using a third color toner 55 contained in a non-interactive developer housing 57 disposed at a third developer station G. An example of a suitable third color toner is magenta. Suitable electrical biasing of the housing 57 is provided by a power supply, not shown.

At a third recharging station H, a pair of corona recharge devices 61 and 62 are employed for adjusting the voltage level of both the toned and untoned areas on the photoreceptor to a substantially uniform level. A power supply coupled to each of the electrodes of corona recharge devices 61 and 62 and to any grid or other voltage control surface associated therewith, serves as a voltage source to the devices. The recharging devices 61 and 62 serve to substantially eliminate any voltage difference between toned areas and bare untoned areas as well as to reduce the level of residual charge remaining on the previously toned areas, so that subsequent development of different color toner images is effected across a uniform development field. The first corona recharge device 61 overcharges the photoreceptor surface containing previously toned and untoned areas, to a level higher than the voltage level ultimately required for $V_{ddp}$, for example to −700 volts. The predominant corona charge delivered from corona recharge device 61 is negative. The second corona recharge device 62 reduces the photoreceptor voltage to the desired $V_{ddp}$, −500 volts. Hence, the predominant corona charge delivered from the second corona recharge device 62 is positive. The surface potential after having passed each of the two corona recharge devices, as well as the amount of voltage split, are preselected to otherwise prevent the electrical charge associated with the developed image from substantially reversing in polarity, so that the occurrence of UCS is avoided. Further, the corona recharge device types and the voltage split are selected to ensure that the charge at the top of the toner layer is substantially neutralized rather than driven to the reverse polarity. These selected parameters are described in further detail with reference to FIGS. 3A–3F.

A fourth latent image is created using an imaging or exposure member 63. A fourth DAD image is formed on both bare areas and previously toned areas of the photoreceptor that are to be developed with the fourth color image. This image is developed, for example, using a cyan color toner 66 contained in developer housing 67 at a fourth developer station I. Suitable electrical biasing of the housing 67 is provided by a power supply, not shown. In a single pass system as shown in FIG. 1, an advantage of developing the color toners in the order hereinbefore described, i.e. black first, is the elimination of the need for one of the two corona recharge devices during the first recharge step, since subsequent color images are typically not developed over the image areas developed with black color toner. Thus, the recharge issues normally present when developing over other color toners is not present during recharge of a photoreceptor surface having a black-first toner image, obviating the need for the advantages presented by the split recharge concept of the present invention during this first recharge step.

The developer housing structures 42, 57, and 67 are preferably of the type known in the art which do not interact, or are only marginally interactive with previously developed images. For examples, a DC jumping development system, a powder cloud development system, and a sparse, non-contacting magnetic brush development system are each suitable for use in an image on image color development system. A non-interactive, scavengeless development housing having minimal interactive effects between previously deposited toner and subsequently presented toner is described in U.S. Pat. No. 4,833,503, the relevant portions of which are hereby incorporated by reference herein.

In order to condition the toner for effective transfer to a substrate, a negative pre-transfer corotron member 50 delivers negative corona to ensure that all toner particles are of the required negative polarity to ensure proper subsequent transfer. Another manner of ensuring the proper charge associated with the toner image to be transferred is described in U.S. Pat. No. 5,351,113, the relevant portions of which are hereby incorporated by reference herein.

Subsequent to image development a sheet of support material 52 is moved into contact with the toner images at transfer station J. The sheet of support material is advanced to transfer station I by conventional sheet feeding apparatus, not shown. Preferably, the sheet feeding apparatus includes a feed roll contacting the uppermost sheet of a stack of copy sheets. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station J.

Transfer station J includes a transfer corona device 54 which sprays positive ions onto the backside of sheet 52. This attracts the negatively charged toner powder images from the belt 10 to sheet 52. A detack corona device 56 is provided for facilitating stripping of the sheets from the belt 10.

After transfer, the sheet continues to move, in the direction of arrow 58, onto a conveyor (not shown) which advances the sheet to fusing station K. Fusing station K includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52 after it is allowed to cool. After fusing, a chute, not shown, guides the advancing sheets 52 to a catch tray, not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station L using a cleaning brush structure contained in a housing 66.

The various machine functions described hereinabove are generally managed and regulated by a controller (not shown), preferably in the form of a programmable microprocessor. The microprocessor controller provides electrical command signals for operating all of the machine subsystems and printing operations described herein, imaging onto the photoreceptor, paper delivery, xerographic processing functions associated with developing and transferring the developed image onto the paper, and various functions associated with copy sheet transport and subsequent finishing processes.

The recharge devices 36, 37, 51, 52, 61 and 62 have been described generally as corona generating devices, with reference to FIG. 1. However, it is understood that the corona generating devices for use in the present invention could be in the form of, for example, a corotron, scorotron, dicorotron, pin scorotron, or other corona charging devices known in the art. In the present example having a negatively charged photoreceptor, the negatively charged toner is recharged by a first corona recharge device of which the predominant corona charge delivered is negative. Thus, either a negative DC corona generating device, or an AC corona generating device biased to deliver negative current would be appropriate for such purpose. The second corona recharge device is required to deliver a predominantly positive charge to accomplish the objectives of the present invention, and therefore a positive DC or an AC corona generating device would be appropriate.

In a preferred embodiment of the present invention and as further described with reference to FIGS. 3A–3F, a negative, high slope, voltage sensitive DC device is used for the first corona recharge device, and a high slope, voltage sensitive AC device is used for the second corona recharge device. This preferred configuration accomplishes the stated objectives of achieving voltage uniformity between previously toned areas and untoned areas of the photoreceptor so that subsequent exposure and development steps are effected across a uniformly charged surface; as well as reducing the residual charge of the previously developed areas so that subsequent development steps are effected across a uniform development field. Further, these objectives are successfully attained while ensuring that toner charge at the top of the toner layer is substantially neutralized rather than driven to reverse its polarity, so that UCS occurrence is avoided.

Figure 2:
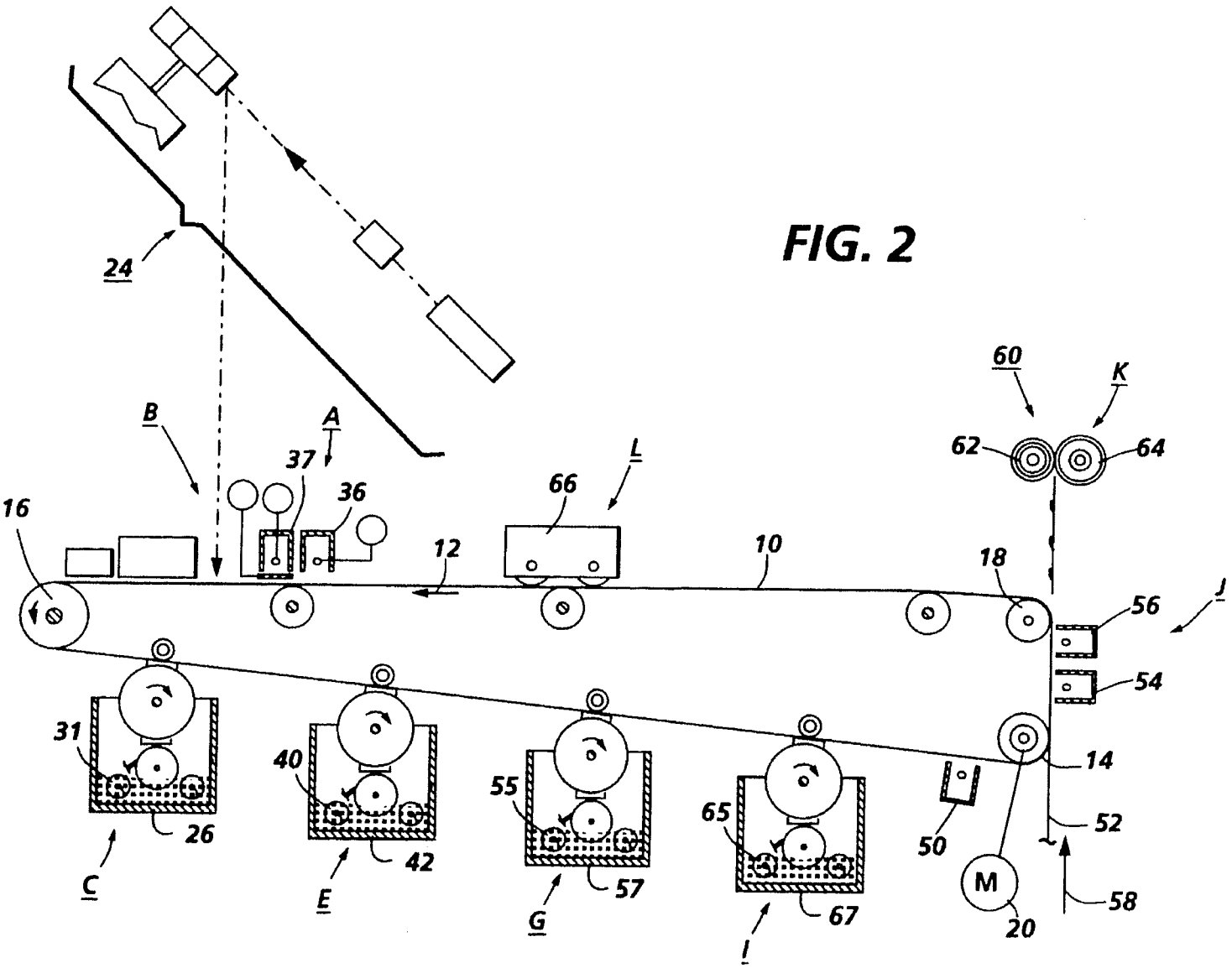
FIG. 2 is a schematic illustration of another imaging apparatus incorporating the development system features of the invention.

FIG. 2 illustrates another example of an electrostatographic printing apparatus which would find advantageous use of the present invention. FIG. 2 represents a multiple pass color image formation process, where each successive color image is applied in a subsequent pass or rotation of the photoreceptor. Like reference numerals to those in FIG. 1 correspond with identical elements to those represented in FIG. 2, with the exception that a non-interactive development system at Development Station C replaces the magnetic brush development system used as an example in FIG. 1, for purposes of illustration of alternate and equivalent embodiments for use with the present invention. Furthermore, in a multi-pass system as represented in FIG. 2, only a single set of recharging devices 36 and 37, indicated generally at charging/recharging station A, is needed to recharge the photoreceptor surface 10 prior to each subsequent color image formation. For purposes of simplicity, both recharging devices 36 and 37 can be employed for initially charging the photoreceptor using the split recharge concept of the present invention as hereinbefore described, prior to the exposure of the first color toner latent image. However, it is understood that a controller (not shown) could be used to regulate the charging step so that only a single recharge device is used to charge the photoreceptor surface to the desired voltage level for exposure and development thereon. Corona recharge device 36 is shown in FIG. 2 without a grid associated therewith, and corona recharge device 37 is shown with a grid, for purposes of illustration of different embodiments of the present invention. Also, only a single exposure device 24 is needed to expose the photoreceptor prior to each color image development. In a multipass system as illustrated in FIG. 2, it is understood that the cleaning station L is of the type that is capable of camming away from the surface of the photoreceptor during the image formation process, so that the image is not disturbed prior to image transfer.

Figure 3A:
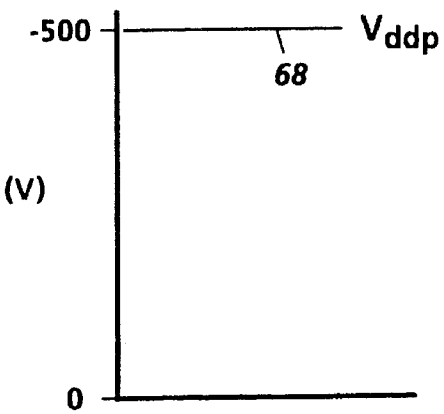
FIG. 3A shows the photoreceptor voltage profile after uniform charging in the present invention.
Figure 3B:
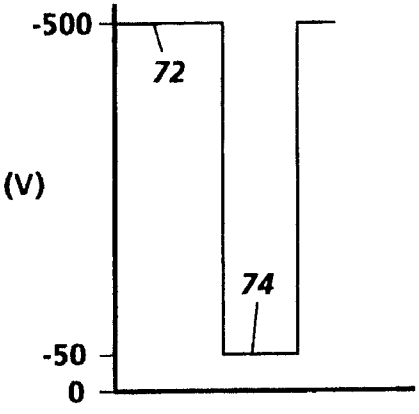
FIG. 3B shows the photoreceptor voltage profile after an exposure step in the present invention.

The voltage profiles on the photoreceptor 10 depicting a single split recharge step of the present invention during the image forming process described with reference to FIGS. 1 and 2, are illustrated in FIGS. 3A through 3F. FIG. 3A illustrates the voltage profile 68 on photoreceptor belt after the belt surface has been uniformly charged. The photoreceptor is initially charged to a voltage slightly higher than the −500 volts indicated ($V_o$) but after dark decay the $V_{ddp}$ voltage level is −500 volts. After a first exposure, the voltage profile comprises high and low voltage levels 72 and 74, respectively. The level 72 at the original −500 volts represents the background area for the first image development step, and the level 74 at −50 volts (FIG. 3B) represents the area discharged by the laser 24 and corresponds to the image area to be developed by a single color toner.

Figure 3C:
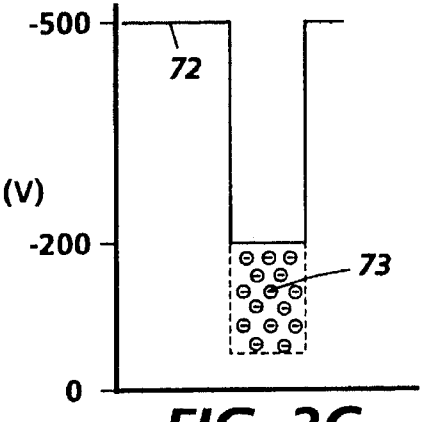
FIG. 3C shows the photoreceptor voltage profile after a development step subsequent to the exposure step of FIG. 3B in the present invention.
Figure 3D:
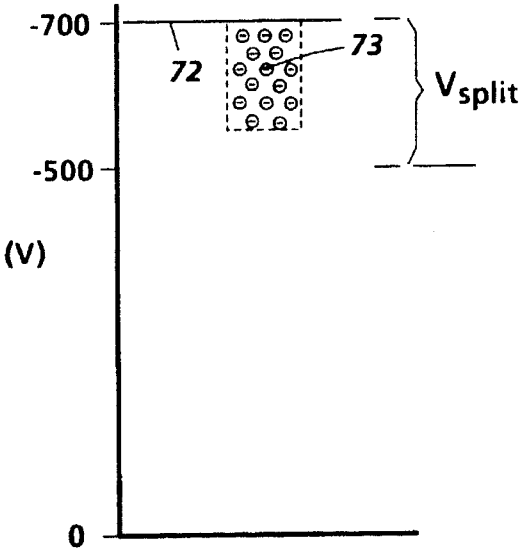
FIG. 3D shows the photoreceptor voltage profile after a first recharging step in the present invention.
Figure 3E:
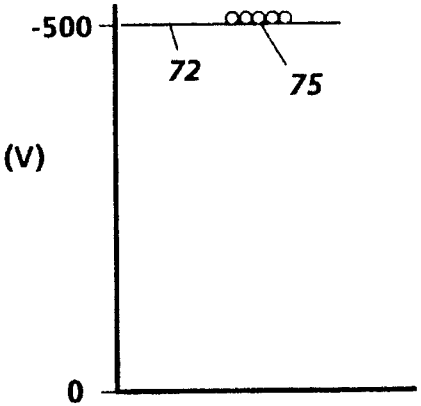
FIG. 3E shows the photoreceptor voltage profile after a second recharging step in the present invention.
Figure 3F:
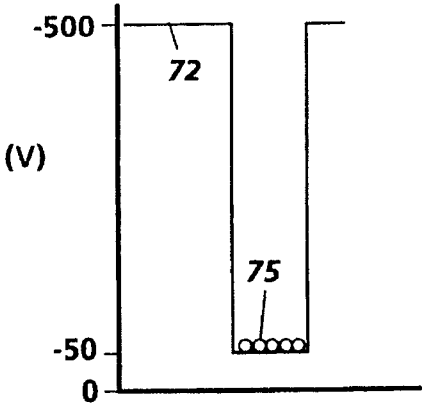
FIG. 3F shows the photoreceptor voltage profile after a subsequent exposure step in the present invention.

During the first development step, the colored toner adheres to the DAD image area and causes the potential in the image area to be increased to approximately −200 volts, as represented by the solid line in FIG. 3C. The toner particles 73 have a negative charge associated therewith.

When the toned and untoned areas of the photoreceptor are subjected to the recharging step (FIG. 3D) using a preferred embodiment of the split recharge concept of the present invention, the first corona recharge device 36 overcharges the toned 73 and background areas 72 of the photoreceptor to a negatively higher level than $V_o$ or the ultimately desired second color $V_{ddp}$. Thus, after passing the first corona recharge device, the photoreceptor surface having the developed image thereon is charged to approximately −700 volts and the toner particles 73 still have a negative charge associated therewith. Preferably, the second AC corona recharge device then delivers a predominately positive current to the photoreceptor surface to lower the photoreceptor potential to a uniform level of approximately $V_{ddp}$ of −500 volts (FIG. 3E) and substantially neutralize the charge of the toner particles 75 in the image area. Thus, the voltage split of the photoreceptor surface after being recharged by the first and second corona recharge devices is 200 volts.

The second charging device, preferably a high slope, voltage sensitive AC scorotron, will deliver current until the voltage of the photoreceptor is equal to the voltage of the grid (minus the offset associated with the scorotron). With use of a voltage sensitive AC scorotron, the voltage at the top of the toner layers and bare photoreceptor reach the grid voltage at a fast rate, and therefore voltage uniformity between the toned areas and untoned areas of the photoreceptor is achieved. Since the AC device delivers both positive and negative ions, it will substantially neutralize the toner charge rather than change it to an opposite polarity (positive). Another factor contributing to the outcome of substantial neutralization of the toner charge is the relatively small $V_{split}$ level applied to the photoreceptor surface between the first and second corona recharge devices. Therefore, in the preferred configuration of a high slope, direct current corona generating device for the first recharge step, used in conjunction with a high slope, voltage sensitive alternating current corona generating device for the second recharge step, whereby a relatively low voltage split of the photoreceptor is applied therebetween, voltage uniformity is achieved between toned and bare areas of the photoreceptor, and the charge at the top of the toner layer is substantially neutralized.

Furthermore, inside a negative toner layer, the high electric fields present typically prevent positive corona ions from getting into the layer. However, by using a high slope, voltage sensitive AC corona generating device as the second of the corona recharge devices of the present invention, more positive charges emanating from the device are able to attach themselves to the top surface of a toner layer, causing the average charge to sit closer to the photoreceptor. The residual voltage $V_t$ of the toner layer is thereby substantially reduced or eliminated, as $V_t$ is directly proportional to the integrated sum of the distances of the negative charges of the toner layer from the photoreceptor surface. A voltage sensitive corona recharge device whose graph of the output current (I) to the photoreceptor surface as a function of the voltage to the photoreceptor surface (V) has a high characteristic (I/V) slope, used for recharging a photoreceptor having a toner image developed thereon, is described in concurrently filed application for U.S. Patent titled "Method and Apparatus for Reduced Residual Toner Voltage", (D/92483), having a common assignee as the present application, the relevant portions of which are hereby incorporated by reference herein.

After this split recharge step (FIG. 3E), the photoreceptor is uniformly charged, the residual toner present on the previously developed toner layer is substantially reduced, and the toner charge at the top of the toner layer is substantially neutralized. The photoreceptor is again ready for image formation thereon by exposing those bare areas and image areas (FIG. 3F) to be developed 75 thereon, whereby a uniform development field has been provided for development of a subsequent color toner.

Figure 4A:
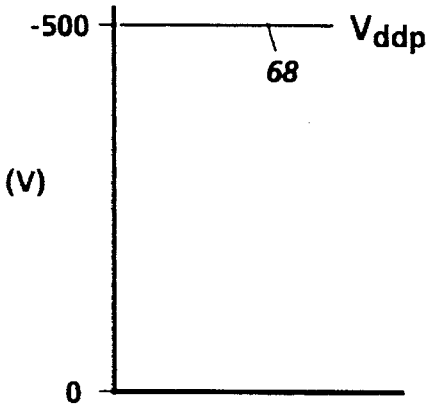
FIG. 4A shows the photoreceptor voltage profile after uniform charging in the prior art.
Figure 4B:
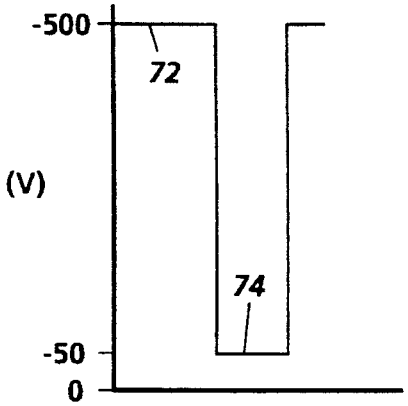
FIG. 4B shows the photoreceptor voltage profile after an exposure step in the prior art.
Figure 4C:
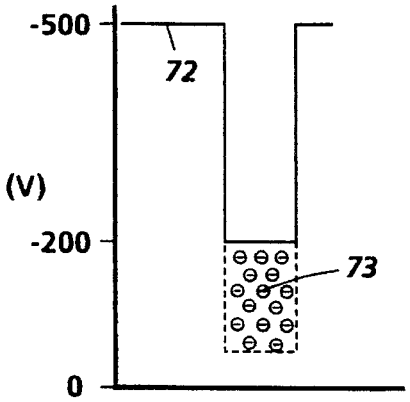
FIG. 4C shows the photoreceptor voltage profile after a development step subsequent to the exposure step of FIG. 3B in the prior art.
Figure 4D:
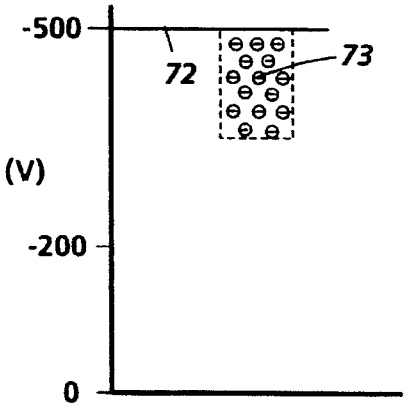
FIG. 4D shows the photoreceptor voltage profile after a recharging step in the prior art.
Figure 4E:
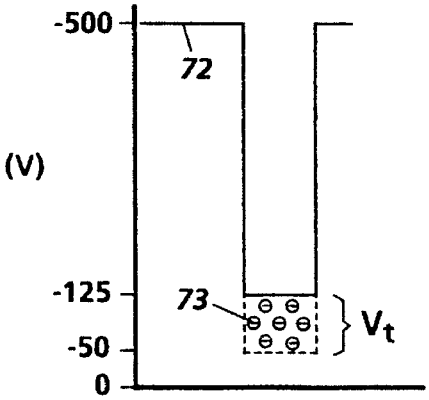
FIG. 4E shows the photoreceptor voltage profile after a subsequent exposure step in the prior art.

An example of a recharging step found in the prior art, wherein a single recharge device is used to recharge a prior developed image on the photoreceptor and the residual toner charge is apparent prior to a subsequent development step, is illustrated in FIGS. 4A through 4E. After uniformly charging the photoreceptor surface 68 (FIG. 4A), exposing an image area 74 (FIG. 4B), and developing that exposed image area with negatively charged toner particles 73 (FIG. 4C), a single recharge step is employed for recharging the developed image areas 73 to a uniform level with the non-developed background areas 72 (FIG. 4D). When the previously toned areas 73 are subjected to a subsequent exposure step as illustrated in FIG. 4E, although the toner charge 73 associated with the developed image is reduced, the voltage drop due to this residual charge $V_t$ is significant, and will thereby impair the development field and subsequent development in these areas.

When developing a subsequent color image on a previously developed toner image which may have a reduced amount of residual charge associated therewith, however, which also has a significant amount of reversed polarity toner at the top of the previously developed toner layer, the attraction of the reverse polarity positive toner to the negative background areas tends to cause the under color splatter defect, as previously described, which can significantly impair color image quality. The level of UCS occurrence has been found to be directly related to the amount of reversed polarity toner at the top of a previously developed toner image, i.e. the greater the amount of reversed polarity toner found at the top of the previously developed toner layers, the increased likelihood and amount of UCS occurrence. Furthermore, the level of UCS occurrence has also been found to be directly related to the amount of $V_{split}$ of the photoreceptor surface between the first and second corona recharge devices, i.e. the UCS defect occurrence is more significant as $V_{split}$ becomes larger. By maintaining $V_{split}$ in the range of 50 to 350 volts, and preferably in the range of 75 to 200 volts, UCS is substantially prevented, whereas a $V_{split}$ of an amount greater than these specified ranges tends to correspondingly demonstrate an increase in UCS occurrence.

In an alternate embodiment of the split recharge concept of the present invention, a constant current device is used for the first corona recharge device. Since the effective capacitance of a toned area of the photoreceptor is lower than the capacitance of the bare photoreceptor, the voltage of the photoreceptor after being charged with a constant current voltage by the first device, as seen by the second device, would be higher in a toned area 73 than a bare background area 72 of the photoreceptor. Therefore, since the voltage, as seen by a high slope recharge device used as the second corona recharge device, e.g. an AC scorotron, of the toned area of the photoreceptor is higher (more negative) than the bare photoreceptor, the AC scorotron will deliver more positive ions to the toned areas than to the bare untoned areas of the photoreceptor, thereby successfully reducing the residual voltage associated with the previously developed image.

While the foregoing description was directed to a $DAD^n$ image on image process color printer where a full color image is built in a single pass of the charge retentive surface, it will be appreciated that the invention may also be used in a charged area development $CAD^n$ or $CAD\text{-}DAD^n$ in both single pass or multiple pass systems, as well as in a single or multiple pass highlight color process machine.

What is claimed is:

1. A corona generating apparatus for recharging a charge retentive surface to a predetermined potential, wherein the charge retentive surface has an image developed thereon having an electrical charge associated therewith, comprising:

a first corona generating device, positioned adjacent the charge retentive surface, for recharging the charge retentive surface to a higher absolute potential than the predetermined potential; and a second corona generating device, spaced from said first corona generating device and positioned adjacent the charge retentive surface, for recharging the charge retentive surface to the predetermined potential, the difference in charge retentive surface potential after being recharged by said first corona generating device and the predetermined potential being preselected so as to substantially neutralize the electrical charge associated with the developed image.

2. The corona generating apparatus according to claim 1, further comprising a direct current source coupled to said first corona generating device.

3. The corona generating apparatus according to claim 1, further comprising an alternating current source coupled to said second corona generating device.

4. The corona generating apparatus according to claim 3, wherein said second corona generating device comprises:

an electrode; and a grid, interposed between said electrode and the charge retentive surface.

5. The corona generating apparatus according to claim 1, wherein the preselected difference in charge retentive surface potential, after being recharged by said first corona generating device and the predetermined potential, ranges from about 50 volts to about 350 volts.

6. The corona generating apparatus according to claim 1, wherein the preselected difference in charge retentive surface potential, after being recharged by said first corona generating device and the predetermined potential, ranges from about 75 volts to about 200 volts.

7. The corona generating apparatus according to claim 1, wherein said first corona generating device and said second corona generating device are voltage sensitive.

8. A printing machine, comprising:

a charge retentive surface having a developed image thereon, the developed image having an electrical charge associated therewith; and a corona generating apparatus for recharging said charge retentive surface to a predetermined potential, said corona generating recharge device including:

a first corona generating device, positioned adjacent said charge retentive surface, for recharging said charge retentive surface to a higher absolute potential than the predetermined potential; and a second corona generating device, spaced from said first corona generating device and positioned adjacent said charge retentive surface, for recharging said charge retentive surface to the predetermined potential, the difference in charge retentive surface potential after being recharged by said first corona generating device and the predetermined potential being preselected so as to substantially neutralize the electrical charge associated with the developed image.

9. The printing machine according to claim 8, further comprising a direct current source coupled to said first corona generating device.

10. The printing machine according to claim 8, further comprising an alternating current source coupled to said second corona generating device.

11. The printing machine according to claim 10, wherein said second corona generating device comprises:

an electrode; and a grid, interposed between said electrode and said charge retentive surface.

12. The printing machine according to claim 8, wherein the preselected difference in charge retentive surface potential, after being recharged by the first corona generating device and the predetermined potential, ranges from about 50 volts to about 350 volts.

13. The printing machine according to claim 8, wherein the preselected difference in charge retentive surface potential, after being recharged by the first corona generating device and the predetermined potential, ranges from about 75 volts to about 200 volts.

14. The printing machine according to claim 8, wherein the multiple images are created during one revolution of said charge retentive surface, further comprising means for developing each of the multiple images with a different color toner, whereby a composite color image is created.

15. The printing machine according to claim 14, wherein said developing means develops a first image of the multiple images with a black color toner.

16. The printing machine according to claim 8, wherein said first corona generating device and said second corona generating device are voltage sensitive.

17. A method for creating multiple images, comprising:

recording a latent image on a charge retentive surface;

developing the latent image, the developed image having an electrical charge associated therewith;

predetermining a surface potential for recharging the charge retentive surface and the developed image thereto;

recharging the charge retentive surface with a first corona generating device to a higher absolute potential than the predetermined potential;

recharging the charge retentive surface with a second corona generating device to the predetermined potential; and substantially neutralizing the electrical charge associated with the developed image.

18. The method according to claim 17, wherein the recharging of the charge retentive surface with a first corona generating device, further comprises delivering a direct current to the charge retentive surface.

19. The method according to claim 17, wherein the recharging of the charge retentive surface with a second corona generating device, further comprises delivering an alternating current to the charge retentive surface.

20. The method according to claim 17, wherein the recharging of the charge retentive surface with a second corona generating device comprises using a high voltage corona generating device including an electrode with a grid interposed between the electrode and the charge retentive surface.

21. The method according to claim 17, wherein said first mentioned recharging step recharges the charge retentive surface so that a difference between the charge retentive surface potential after the first recharging step and the predetermined potential ranges from about 50 volts to about 350 volts.

22. The method according to claim 17, wherein said first mentioned recharging step recharges the charge retentive surface so that a difference between the charge retentive surface potential after the first recharging step and the predetermined potential ranges from about 75 volts to about 200 volts.

23. The method according to claim 17, further comprising creating the multiple images during one revolution of the charge retentive surface.

24. The method according to claim 17, further comprising developing each of the multiple images with a different color toner, so that a composite color image is formed.

25. The method according to claim 24, further comprising developing the first one of the multiple images with a black color toner.

* * * * *